United States Patent [19]

Wilkinson et al.

[11] Patent Number: 4,936,111

[45] Date of Patent: Jun. 26, 1990

[54] CROSSED PISTON COMPRESSOR WITH VERNIER OFFSET PORT MEANS

[75] Inventors: William H. Wilkinson, Columbus; James H. Saunders, Worthington, both of Ohio

[73] Assignee: Battelle Memorial Institute, Columbus, Ohio

[21] Appl. No.: 161,189

[22] Filed: Feb. 26, 1988

[51] Int. Cl.[5] ..... F25B 31/00; F04B 25/00; F04B 29/00

[52] U.S. Cl. ..... 62/504; 62/505; 62/524; 417/462

[58] Field of Search ..... 62/200, 504, 524, 505; 417/265, 266, 462, 463

[56] References Cited

U.S. PATENT DOCUMENTS

| | | | |
|---|---|---|---|
| 1,439,629 | 12/1922 | McCarthy | 417/462 |
| 2,095,009 | 10/1937 | Philipp | 62/200 |
| 2,423,386 | 7/1947 | Hubacker | 62/200 |
| 3,139,835 | 7/1964 | Wilkinson | 418/180 |
| 3,157,024 | 11/1964 | McCrory et al. | 62/6 |
| 3,799,035 | 3/1974 | Lamm | 417/462 |
| 4,332,144 | 6/1982 | Shaw | 62/512 |

*Primary Examiner*—John J. Vrablik

*Attorney, Agent, or Firm*—Watkins, Dunbar & Pollick

[57] ABSTRACT

A system and apparatus for compressing gaseous fluids, especially refrigerant gas vapors operating in refrigeration cycles, combining reciprocating pistons in a rotating cylinder member which is mounted for rotation in a stationary frame and is driven by an external source of rotative power. The cylinder block rotates in an encircling port ring member which contains inlet, interstage, and outlet port sets with the number of port sets, numbering more or less than the number of cylinders, to provide a vernier effect in the timing of connections between the port sets and the cylinders.

22 Claims, 7 Drawing Sheets

CROSSED PISTON COMPRESSOR WITH VERNIER OFFSET PORT MEANS

FIELD OF THE INVENTION

This invention relates to the field of rotary compressors of the type used to compress refrigerant gas vapors in refrigeration cycles and apparatus. In particular, it relates to a system and apparatus combining reciprocating pistons in a rotating cylinder member which is mounted for rotation in a stationary frame and is driven by an external source of rotative power.

BACKGROUND OF THE INVENTION

Most refrigeration and heat pump devices operate on a thermal cycle which requires the compression of a refrigerant gas such as R22 freon, although other gases are also in common use in compression refrigeration cycles. In such devices and refrigeration methods, it is well recognized that efficiency and COP are enhanced when the vaporized refrigerant is compressed in stages and the liquid refrigerant is expanded in stages. Because of the uneconomical increases in the size of compressing equipment, the practice of using a dual or multiple compression cycle has not become common. In such devices the low suction pressure gas is admitted to a first stage cylinder. When elevated to intermediate stage pressure the gas or a portion thereof is admitted to a second stage of cylinders wherein the pressure of the gas is raised again. At the end of the second stage it may be at the proper condition for admission to the condenser, or it may be pre-cooled, before expansion into the condenser. In certain circumstances, in some instances, further stages are added.

Reduction in the size of two stage refrigerant compression systems is known to be possible by also accomplishing the expansion of the liquid in two stages. The first expansion is from condenser pressure to the intermediate pressure where a chamber allows the expanded vapor to be separated into its liquid and vapor portions. The liquid is expanded to evaporator pressure and the reduced mass flow of vapor entering the first compression stage from the evaporator reduces the physical size requirements of the compressor. The vapor separated from the liquid expansion at interstage pressure joins the vapor discharge from the first compression stage as a combined inlet to the second compression stage. Further reductions in compressor size are known to be possible by injecting the separated vapor at intermediate pressure into a single stage compressor after the low pressure inlet is completed.

As a matter of convenience the term "dual compression systems" will be used herein, it being understood that more than two stage systems should be included in the concepts where appropriate.

In some systems and apparatus, a plurality of pistons and cylinders operate separately and are interconnected to a common, or a plurality of, crankshafts which are turned by a power source.

Rotary compressors are commonly used, with conduits interconnecting the compression chambers, with appropriate check valves, etc.

U.S. Pat. No. 3,139,835 Wilkinson, by the same inventor as of this invention, reveals a gear teeth-like rotary pump in which rotatable elements provide a plurality of fluid compartments of continuously varying dimensions. The device is described as a compressor when it is used to pump a compressible fluid. Compressed fluid is ejected from the compartments through ports into an encircling member containing a distribution duct. The distribution duct passes the first stage compressed fluid from the discharge ports of the first stage compression compartments to a plurality of second stage compression compartments.

In the patent, the number of "gear" teeth is one less than the number of fluid compression compartments and the number of compression compartments is one less than the number of port sets in the manifold which surround the exterior of the fluid compartment ring. These compression compartments are influenced and controlled by the eccentricity of the drive shaft relative to the center of the drive planet pinion, which is rotating in the driven planetary ring gear.

In the operation of that device, there is a "vernier" effect between the ports and the manifold chambers so that with each revolution of the compression compartment ring, a port in each compartment connects with a successive manifold chamber on the internal periphery of the port ring, and the external periphery of the compression chamber ring. This vernier effect makes it possible to equalize the port pressure at the time of opening of the discharge ports from the compression chambers in the device, even though the device has a greater number of compression chambers than gear teeth on the internal compressor gear. More importantly, the vernier action reduces the relative velocity between the port ring and the compression compartment ring to reduce the friction drag at the clearances necessary to limit leakage.

U.S. Pat. No. 3,157,024 to McCrory and Wilkinson, the latter being the same inventor as of this invention, discloses a crossed piston device operated with an open regenerative thermal cycle (Ericcson). The crossed piston device operates by means of an eccentrically positioned crank bearing on a crankshaft to move a pair of oppositely disposed pistons rotatively connected to the bearing of the crankshaft. The pistons reciprocate in a cylinder block which may be rotatively disposed in an encircling port or manifold ring. As seen in FIGS. 22 and 23 the number of port positions is less, relative to the number of pistons, there being four in the examples shown. As shown, there are three port positions and four piston cylinder combinations.

In this patent a vernier effect is provided for the purpose of controlling the working fluid flow between the pairs of cylinders that accomplish the sequential open cycle process.

The principles of operation of the cross cylinder device are shown in FIGS. 1–5 and 6–9 of the reference patent, as described in Columns 3 beginning at Lines 44 and through Column 4, Line 47. The description therein is included herein by reference for understanding of the invention to be described in this disclosure.

U.S. Pat. No. 4,332,144 Shaw discusses the advantages of utilizing a scavenge vapor generator or recovery heat exchanger as a means of increasing the coefficient of performance in vapor compression closed loop refrigeration and heat pump systems, through staging the expansion of the liquid refrigerant. In that device the higher pressure scavenge refrigerant enters the interior of the compression chamber as vapor through ports that are opened near the bottom dead center position of the piston so that the same piston stroke is subdivided so as to accomplish a two-stage effect without the added size of two separate compression stages. This patent is a typical example of prior art endeavors to increase the efficiency of the compressor and the system by properly timing the admission of higher pressure gas without excessive displacement increases.

SUMMARY OF THE DISCLOSURE

This invention is a compressor apparatus for pressurizing a gaseous fluid in dual, or more than one, stages comprising: a plurality of pistons connected in pairs in a rotating cylinder block, with the cylinder block rotating in an encircling port ring having a plurality of inlet, interstage, and outlet port sets, with the number of port sets being one less or one more than the number of piston and cylinder combinations, and with the encircling port ring being stationary and a component of the supporting frame of the apparatus; so that there is a vernier progression or regression of the opening of the port sets relative to the cylinders in the cylinder block. The invention is particularly useful in an injected dual stage vapor compression refrigeration system by providing improved design freedom in the sizing of the interstage injection ports.

The foregoing and other advantages of the invention will become apparent from the following disclosure in which a preferred embodiment of the invention is described in detail and illustrated in the accompanying drawings. It is contemplated that variations and structural features and arrangement of parts may appear to the person skilled in the art, without departing from the scope or sacrificing any of the advantages of the invention which is delineated in the included claims.

A PREFERRED EMBODIMENT OF THE BEST MODE OF CARRYING OUT THE INVENTION

Figure 1:
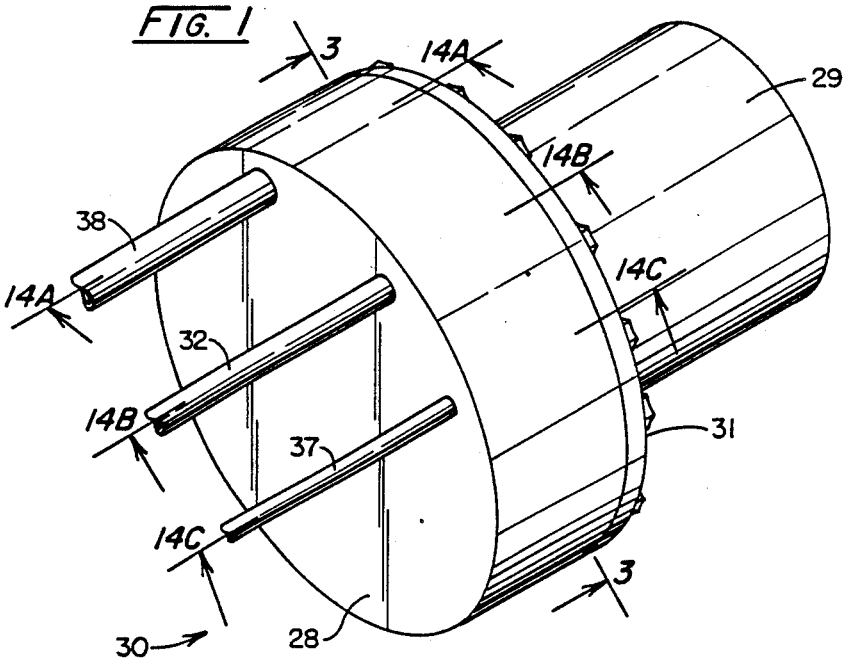
FIG. 1 is an overall perspective view of the apparatus of this invention from without the frame structure.

Referring to FIGS. 1-3, 5 and 7, an input crankshaft 25 provides a central axis of rotation 26, about which the various components rotate in the operation of a compressor apparatus 30. A motor 29 drives the apparatus 30.

In the apparatus 30, a supporting frame 31 includes an inlet manifold 83, an outlet manifold 84, and an interstage manifold 85, as it mates with end frame 28.

Figure 14A:
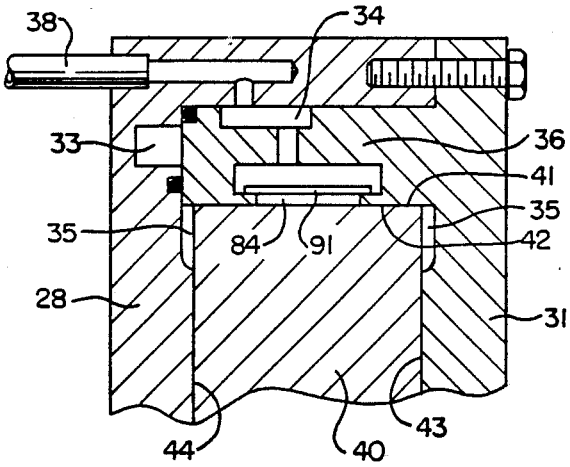
FIGS. 14A, 14B and 14C are sectional views along a radial plane showing portions of the internal manifold arrangement of the invention at the positions shown in FIG. 1.
Figure 14B:
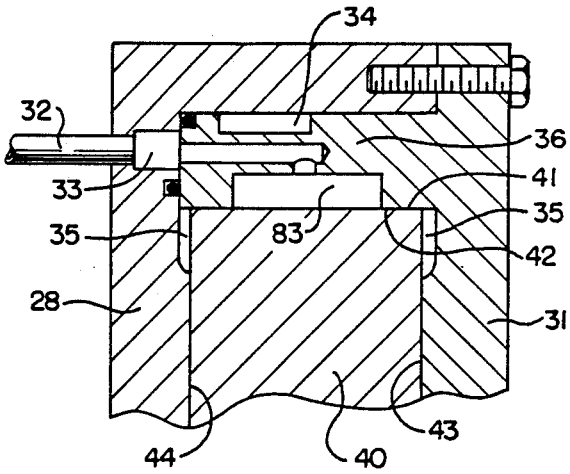
Figure 14C:
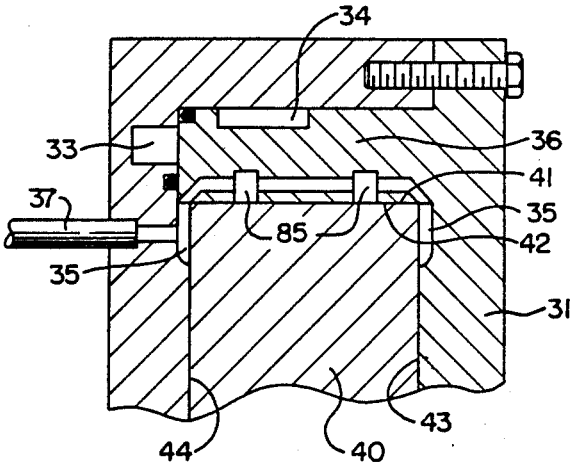

Referring to FIGS. 14 and 1, an inlet conduit 32 is in fluid communication with the inlet manifold 33. An interstage conduit 37 is in fluid communication with interstage manifold 35, and an outlet conduit 38 is in fluid communication with the outlet manifold 34. In the configuration shown, the internal space of the mechanism acts as the interstage manifold 35.

Figure 3:
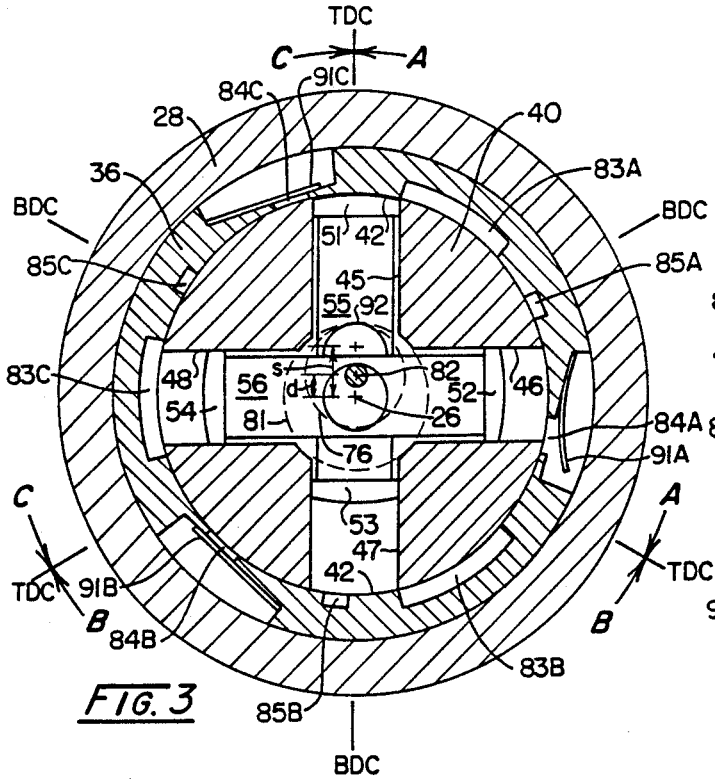
FIG. 3 is an elevational generally schematic section view of the plane along Line 3—3 of FIG. 1 and lying perpendicular to the drive axis.

Referring to FIGS. 14 and 3, the support frame 31 includes a port ring portion 36, which is generally annular in configuration, with the central axis coinciding with central axis 26 of the apparatus. The port ring portion 36 is divided into equal angular segments of A, B, and C of 120° between planes at TDC.

A rotary cylinder block 40, having a generally annular outer surface 41, mates with and slides rotationally with an annular surface 42 of the port ring 36. The cylinder block 40 rotates about the central axis 26. Cylinder block 40 is maintained in its longitudinal position on the axis 26 by the end plate 43 of supporting frame 31 and end frame 28 (See FIG. 14).

Rotary cylinder block 40 is provided with oppositely disposed cylinder bores 45, 46, 47 and 48. The axis of the cylinder bores 45-48 are on a generally central common plane 50 of the apparatus 30, as shown in FIG. 4.

Figure 2:
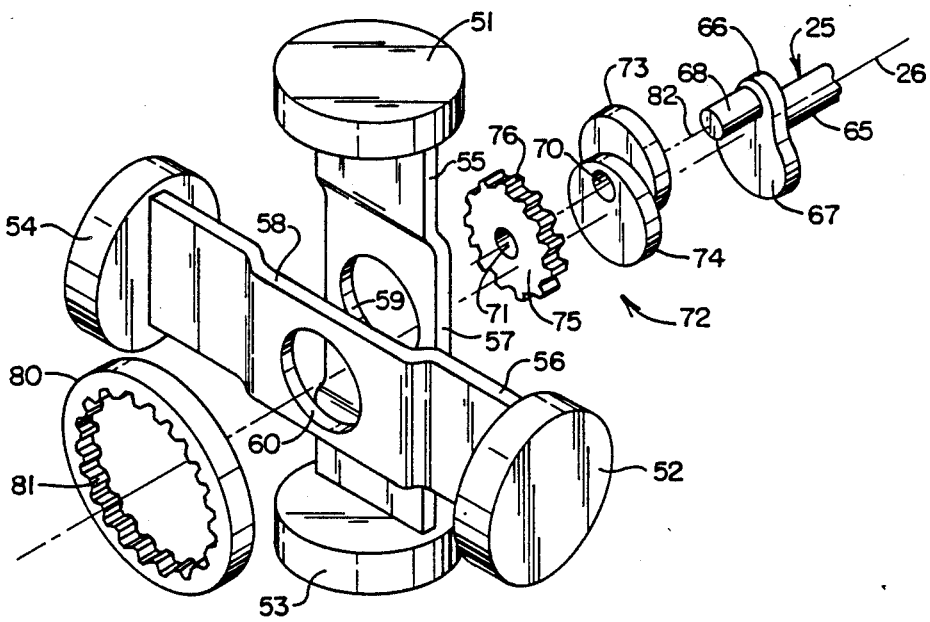
FIG. 2 is an exploded view of the internal parts of the apparatus showing the general assembly relationship of the components.
Figure 4:
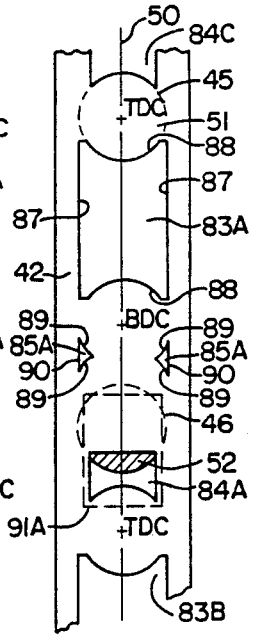
FIG. 4 is a schematic development of the cylindrical surface between the rotary block member and the port ring member of the apparatus, from a point TDC to another next point TDC, including an angular segment of one third of the port ring member indicated as segment A in FIG. 3.

Referring to FIGS. 2, 3 and 4 a plurality of pistons 51, 52, 53, and 54 are mounted for reciprocation within the cylinders and in the common plane 50, Oppositely disposed pistons 51 and 53 are connected by a common rigid piston rod 55 and oppositely disposed pistons 52 and 54 are connected by another rigid piston rod 56. Connecting rods 55 and 56 are provided with oppositely disposed offset portions 57 and 58, as shown most effectively in FIG. 2. Offset portion 57 is provided with a bearing 59 and offset portion 58 is provided with a bearing 60.

The input crankshaft 25 includes an input portion 65 (which is connected to motor 29), an eccentric portion 66, and a counterweight portion 67. The eccentric portion 66 is provided with an offset shaft 68 which is constructed to rotate freely in a plurality of bearing surfaces 70 and 71 of a planet assembly 72.

The planet assembly 72 comprises offset and opposite eccentrically positioned journal portions 73 and 74 and a timing gear pinon 75 having teeth 76. The eccentric journals 73 and 74 and the timing pinon gear 75 are keyed and connected together as one integral unit, and may be an integrally cast unitary component according to manufacturing preference.

A timing ring gear 80, having internal teeth 81 is configured to mesh with the teeth 76 of timing pinon gear 75, and is fastened to the end frame 28. The central axis of the timing ring gear 80 coincides with the central axis of the apparatus 26. Alternatively, the timing ring gear 80 may be formed as an integral part of the support frame 31 or endframe 28.

Referring to FIGS. 2, 3, 5, and 7 the rotational axis 82 of the eccentric portion 68 is offset from the central axis 26 of the apparatus 30 by a distance "d" As the input shaft 65 rotates, the timing gear pinon 75 is carried in meshing planetary engagement with the timing ring gear 80, causing rotation of the planet assembly 72. The rotation of the planet 72 causes the pistons 51–54 to reciprocate within their mating cylinders 45–48. The eccentric mounting of the bearing members 73 and 74 provides the thrust to the pistons, and produces their reciprocation through a stroke distance "s" which is 4 times distance "d".

The diameters of the timing gears 75 and 80 determine the relative motion between the block 40 and the stationary port ring 36. For the case illustrated in FIGS. 3–11 where three porting segments, A, B, and C are defined, the diameter of the pitch circle 76 of the timing pinon 75 is equal to 4 times the distance "d" and the diameter of the pitch circle 81 of the timing ring 80 is 6 times the distance "d".

As shown in FIG. 3, the piston 51 is shown at TDC (top dead center) position, i.e. at the extreme outward location in the cylinder 45. Conversely the piston 53, which is attached to the same connecting rod 55 is at BDC (bottom dead center) position which is at the opposite extreme position of the unit containing the components 55, 51, and 53.

Referring to FIG. 3, the pistons 52 and 54 are in mid stroke position and their axes are 90° and 270° respectively rotated from the piston 51, and piston 53 has its axis "rotated" 180° from piston 51. These rotation angles represent the relative timing, or progression, of each of the pistons through their respective cyclic processes, each cycle representing a timing angle span of 360°

As the crank turns, the reciprocation of the piston in the cylinder causes rotational movement of the rotary block 40, so that there has been a 90° rotation of the block 40 when cylinder 45 and piston 51 reach the position shown for piston 52 in FIG. 3.

Within each segment A, B, and C of port ring 36 are provided port sets, including an inlet port 83, an outlet port 84, and one or more interstage ports 85.

Referring to FIG. 3, piston 51 is shown in cylinder 45 at the TDC position, and cylinder 45 is shown in the TDC position, relative to ports 83 and 84 in FIG. 4. The inlet port 83 has an interface configuration on the surface 41 including parallel sides 87, and end portions 88 of arcuate configuration having a radius to match the radius of the cylinder 45, as well the other cylinders 46, 47, and 48, which also has the same radius as the pistons 51, 52, 53, and 54.

Therefore, at the position shown in FIG. 3, the cylinder 45 and piston 51 are covered by the port ring surface 42, but the inlet port 83 begins to uncover the cylinder 45 as rotation moves clockwise from the TDC position. As rotation continues, the inlet port 83 becomes completely uncovered and piston 51 proceeds inward on a suction stroke drawing low pressure refrigerant gas from the manifold 33 connected to port 83.

At the position shown at FIGS. 3 and 4, the interstage port 85 is covered by the cylinder block 40. As seen in FIG. 4, the configuration of the interstage port 85 is generally triangular in shape having two sides 89 that conform to the radius of the pistons and cylinders, and one side 90 which is parallel to the plane 50. For balance in operations, two interstage ports 85 are shown, one on each side, but the number and configuration may be modified as design circumstances require.

In the preferred embodiment shown, at the position shown in FIG. 4, the position of the cylinder 47 with piston 53 at BDC is shown as in phantom line since it actually is meshing with the inlet port of Segment B. It is shown for convenience in FIG. 4 since the ports in each of these segments are identical.

With further reference to FIG. 3, as positioned by the eccentric shaft position 82, pistons 52 and 54 are at mid-stroke position in cylinders 46 and 48 respectively. Piston 52 is on the compression stroke, as shown by the arrow, and piston 54 is on the suction stroke as shown by the arrow, drawing low pressure gas from the inlet 83 in that segment C. As shown in FIG. 3, a flexible reed valve 91 is deflected to the open position allowing high pressure gas to be discharged through port 84. The reed valve 91 is shown in phantom in FIG. 4 and piston 52 is visible through port 84 (as shown cross-hatched). Both cylinder 45 and cylinder 46 are ported by segment A as shown in FIG. 3, while cylinder 47 is ported by segment B, and cylinder 48 is ported by segment C. In the preferred embodiment, these port segments are identical.

Figure 5:
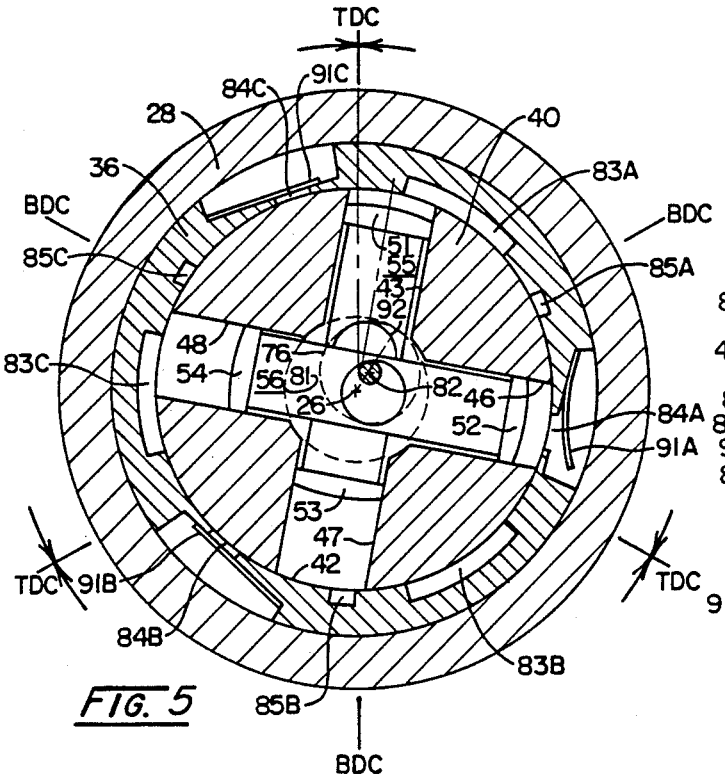
FIG. 5 is an elevational generally schematic section view of the plane along the line 3—3 of FIG. 1 and being perpendicular to the drive axis, with the rotary block member rotated 10° clockwise from the position shown in FIG. 3.
Figure 6:
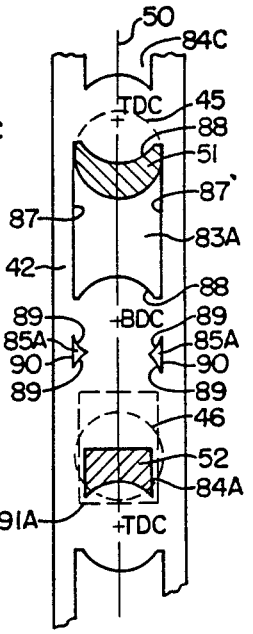
FIG. 6 is a schematic development of the cylindrical surface between the rotary block member and the port ring member of the apparatus, from a point TDC to another next point TDC, including a angular segment of one third of the port ring member indicated as segment A in FIG. 3, corresponding to the position shown in FIG. 5.

Referring to FIG. 5, the crank axis 82 has rotated 40 degrees around the rotation center 26, the block 40 has rotated 10 degrees, and the piston 51 is at the 30 degree position of a 360 degree sinusoidal motion relative to cylinder 45 in block 40. At this point in the stroke of piston 51, suction is beginning from inlet port 83 in port segment A as cylinder 45 is uncovered and piston 51 is overlapped and seen, as shown in FIG. 6.

Piston 52 continues on the compression stroke, (as also crosshatched in FIG. 6), forcing gas from the discharge port 84 in segment A. The reed valve 91 remains open and the top of piston 52 is visible (as crosshatched in FIG. 6). At the position shown in FIG. 5, piston 53 is beginning the compression stroke in segment B and piston 54 is finishing its inlet stroke approaching BDC position in segment C. Reed valves 91B and 91C are shown closed, sealing the discharge from backflow to the ports 84 which are themselves sealed by the surface of block 40. The circular pitch line of ring gear teeth 81 is shown concentric with the axis 26 of the apparatus. The circular pitch line of the timing pinion gear teeth 76 is shown in meshing contact with the ring gear teeth 81 at point 92 at the angle of the crank position 82.

In FIG. 5, the inlet port 83 of segment A is partially open on the low pressure suction stroke, the interstage port 85 is closed, and the high pressure discharge port 84 is open in segment A. In segment B, the interstage port 85B is uncovered and open, the inlet port 83B is closed, and the outlet port 84B is closed.

In segment C, inlet port 83C is open, interstage port 85C is closed, and discharge port 84C is closed.

Figure 7:
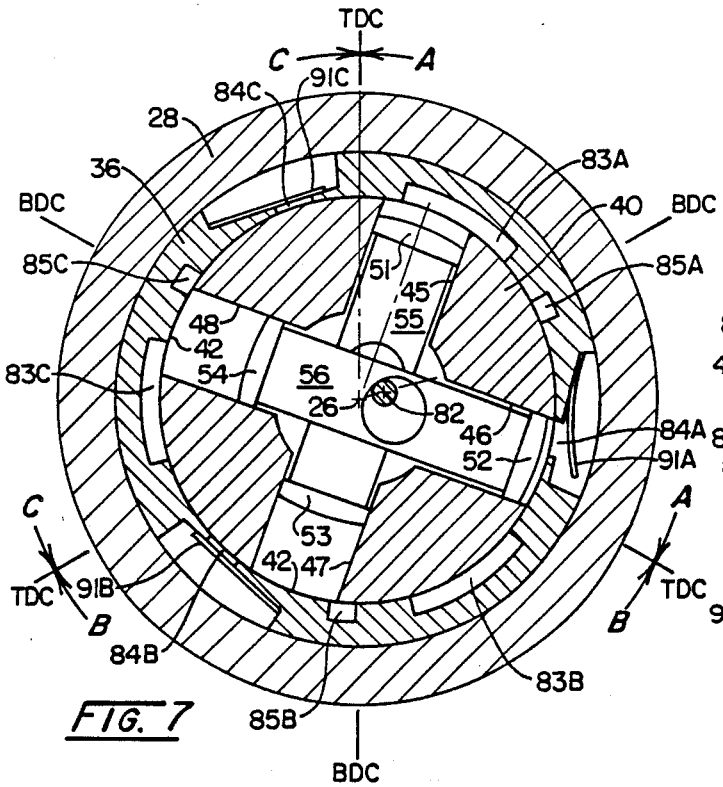
FIG. 7 is an elevational generally schematic section view of the plane along the line 3—3 of FIG. 1 and lying perpendicular to the drive axis, with the rotary block member rotated 20° clockwise from the position shown in FIG. 3.
Figure 8:
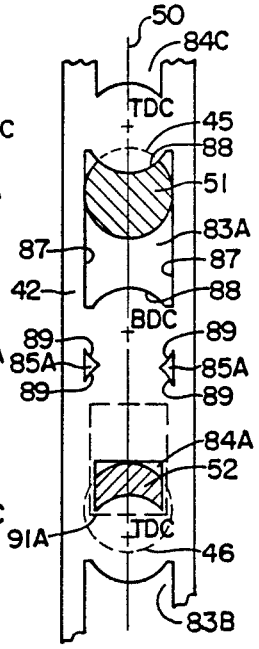
FIG. 8 is a schematic development of the cylindrical surface between the rotary block member and the port ring member of the apparatus, from the point TDC to another next point TDC, including a angular segment of one third of the port ring member indicated as segment A in FIG. 3, corresponding to the position shown in FIG. 7.

Referring to FIGS. 7 and 8, piston 51 is shown further advanced on the suction stroke as the crank axis 82 has moved to the 80 degree position from TDC and the cylinder block 40 has rotated 20 degrees from TDC in segment A. Piston 52 is approaching TDC at the end of the high pressure discharge stroke and reed valve 91 remains open under the discharge pressure. Interstage port 85 remains covered.

When piston 52 reaches the TDC position in port segment A, piston 51 is still in the inlet process of segment A; piston 53 is further along the compression process in segment B; and piston 54 is still in the inlet process in segment C., Further crank rotation moves piston 52 beyond TDC and into the inlet process and this inlet process is now in port segment B.

It is apparent in the embodiments shown, wherein three port sets including an inlet port, an interstage port, and an outlet port are divided within three segments on the periphery of the port ring, and the crossed piston apparatus including a rotary block, crossed pistons and cylinders rotating therein numbers four, that each cylinder (piston) advances one third of a revolution, traversing a full segment and passing to the next sequent with each rotation of the drive. This progression from segment to segment provides a vernier effect with respect to the opening of the various ports.

This vernier effect provides for the admission of a gas at higher pressure immediately after BDC position as shown by port 85B in segment B of FIG. 3. At this point in the cycle, the cylinder 47 is filled with low pressure gas and the inlet port 83B has just closed, and the compression stroke is about to begin. Immediately therewith or thereafter, the interstage ports begin to open, and interstage pressure is injected for a timed interval and at a rate controlled by the configuration of the ports 85, i.e. their size and shape as well as the interstage pressure in the system. At this position, the low pressure inlet ports 83 and the discharge ports 84 are closed, and remain so for the admission of gas at interstage pressure, as seen in Segment B of FIGS. 3, 5 and 7. For illustrative convenience, the relationship of cylinder 47 to port 85 in segment B is not shown in FIG. 4, since in this preferred embodiment, the port in segments A and B are identical.

Figure 9:
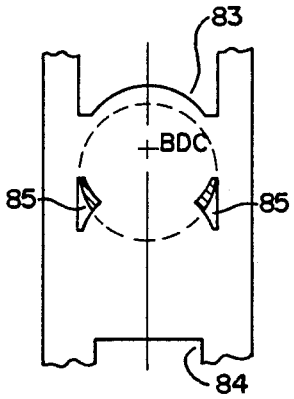
FIG. 9 is a portion of the schematic development of the cylindrical surface between the rotary block member and the port ring member of the apparatus in segment B of FIGS. 3, 5 and 7 showing a position of the opening of the interstage ports.
Figure 10:
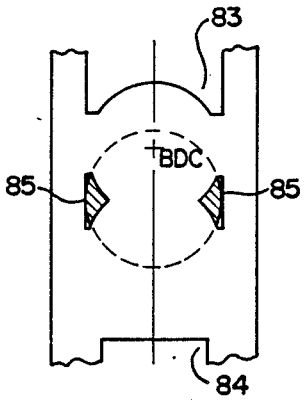
FIG. 10 is a schematic development view of the further progression of the schematic development shown in FIG. 9.
Figure 11:
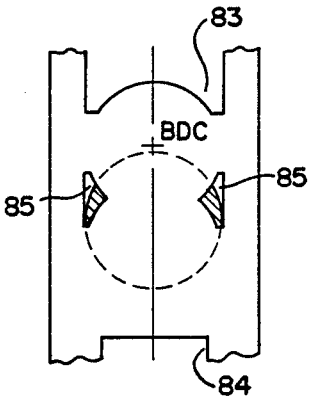
FIG. 11 is a schematic development view of the further progression of the interstage port shown in FIGS. 9 and 10.

As shown in FIGS. 9, 10 and 11, with the amount of opening of the interstage ports 85 from the 195 degree position shown in FIG. 9, through the 210 degree position shown in FIG. 10, and the 225 degree position shown in FIG. 11, it is seen that the interstage port 85 opens and closes completely after BDC position and entirely during a period when the low pressure inlet port 83 and the discharge ports 84 are closed.

In the conventional crankshaft and reciprocating piston compressor mechanism, the interstage port must be uncovered on the suction stroke, gradually recovered on the compression stroke, and in current embodiments, it is not possible in any convenient way to delay the interstage injection process until the BDC suction stroke is completed. See U.S. Pat. No. 4,332,144, FIG. 5.

While this invention has advantages in various circumstances, it is particularly advantageous when the compressor apparatus is employed in an injected two-stage vapor compression refrigeration cycle. In this cycle, refrigerant gas from the condenser is expanded to interstage pressure in a separator which allows for separation of the gas into a liquid phase and a gas phase at the intermediate interstage pressure. From the separator, the vapor at interstage pressure is passed forward to the interstage pressure manifold 35 (see FIG. 14) through conduit 37, and from there it is drawn into the cylinders through ports 85 when the pistons and cylinders are at the positions described above. Liquid refrigerant from the separator is passed through an expansion valve to the evaporator where it is evaporated before being returned to the low pressure inlet manifold 33 of the compressor 30.

Figure 12:
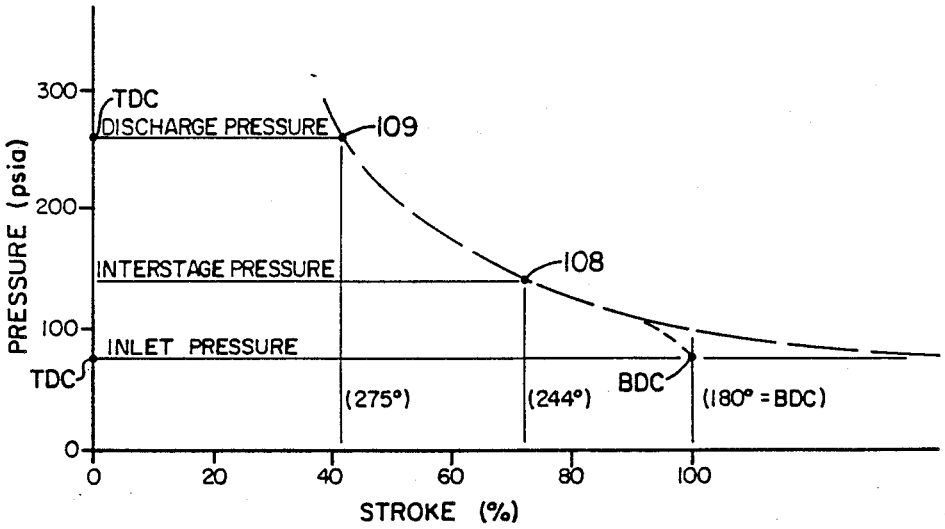
FIG. 12 is a graph of Pressure versus Stroke for operating conditions within the cylinders of the apparatus.

Referring to FIG. 12, conditions within a cylinder of the compressor are shown. When the piston passes TDC, gas enters at the inlet pressure for the full length (100%) of the suction stroke, the crank is turned 180 degrees relative to the cylinder block 40 to BDC position. Immediately after BDC stage in the embodiment shown, interstage valve 85 begins to open and interstage pressure gas is injected to the cylinder from 180 degrees to 240 degrees of crank angle. At approximately the 72 per cent position of the return stroke, the interstage pressure is reached and valve 85 is closed. The piston continues on the compression stroke to 275 degrees of crank angle and at the position of approximately 42 percent of the return stroke the discharge reed valve 91 opens allowing discharge through port 84 to the manifold 34 and conduit 38. Thereafter the gas is forced out discharge port 84 for the remainder of the stroke to 0 crank position and TDC.

Figure 13:
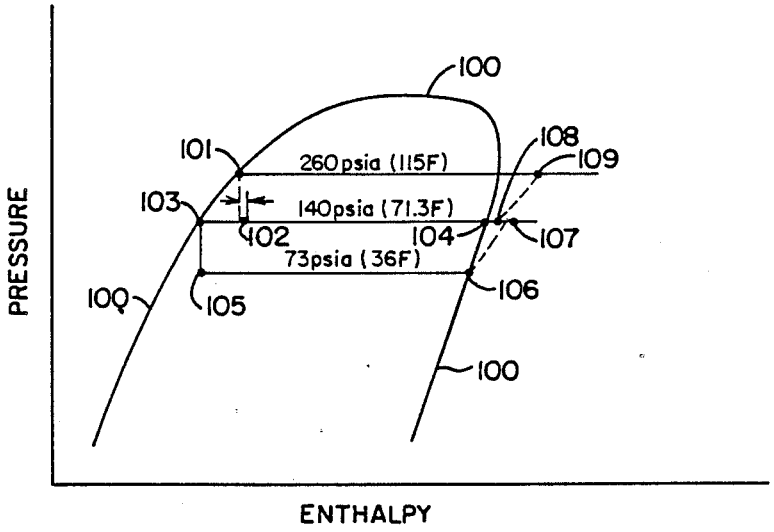
FIG. 13 is a Pressure versus Enthalpy diagram for operating conditions within a cylinder of the apparatus, when the apparatus is being operated as a compressor for R-22 Freon refrigerant gas.

Referring to FIG. 13, the pressure enthalpy diagram for saturation points for the Freon refrigerant R22, are shown as the curve 100. When operating in the injected two-stage compressor apparatus of this invention, the refrigerant enters through an expansion valve 101 beginning at the saturated liquid condition. The pressure is reduced at constant heat (enthalpy) except for motor cooling to the interstage pressure of the separator 102.

The enthalphy rise from points 101 to 102 represent the addition of energy to the fluid from the cooling of the motor. The cooling of the motor can be accomplished with the same theremodynamic effect regardless of the stream of refrigerant or solution used to cool the motor, either liquid or vapor, with the ultimate separation being a liquid portion at points 103 and 104. Incidental superheat beyond the saturated vapor point 104, that might occur from the specific means of motor cooling, could occur without departing from the concept of motor cooling and phase separation. At the interstage pressure of 140 psi, a liquid portion is collected and passed through a second expansion valve 103 where the refrigerant is reduced in pressure to the evaporator pressure of about 73 psi at the entrance 105. Expanded low pressure refrigerant receives heat in the evaporator and is conveyed to the low pressure inlet 106. As each piston leaves BDC, opening of the interstage port 85 causes injection flow of vapor refrigerant at 104 from the separator. This flow and the compression of the piston combine to bring the cylinder pressure to interstage pressure of about 140 psi at condition 108. With the closing of interstage ports 85, the compression continues up to condenser pressure 109.

Because interstage valve 85 opens after BDC, there is no "premature" injection of refrigerant at interstage pressure during the suction stroke. This means that the swept volume of the cylinder is more efficiently used because the swallowing capacity of the compressor cylinder is increased. Translating this into design parameters, the compressor is smaller for a given capacity and requires less input power. This important advantage results from the fact that point 104 will stay closer to point 106 in the operation of a compressor of this invention relative to the type of interstage injecting disclosed in U.S. Pat. No. 4,332,144, FIG. 5, since less injection pressure is required because of the larger port area.

Figure 15:
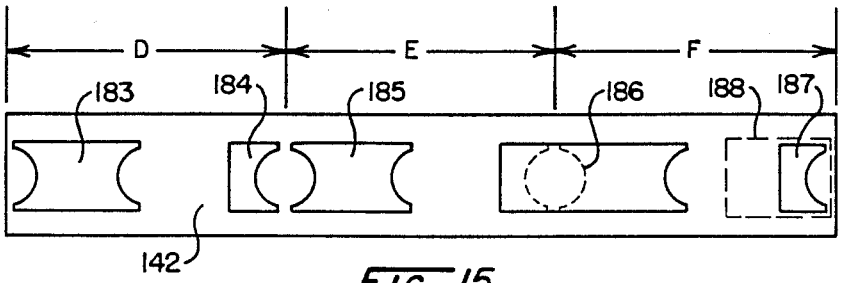
FIG. 15 is a schematic development of the cylindrical surface between the rotary block member and the port ring member of the apparatus according to an alternative embodiment described, including the complete circumference of the port ring.

Referring to FIG. 15 an alternative arrangement that is less compact but which may provide improved efficiency in special cases would have modified port segments, so that two segments (for example) are alike and the third segment is different.

In this embodiment of a two-stage system, a first low stage inlet port 183, a second low stage inlet port 185, and a low stage discharge port 184 are provided in the development of the port ring surface 142. The inlet port 183 and the inlet port 185 are identical. The discharge port 184 is identical with the discharge on E as to opening timing, but because the discharge from D and E goes to the inlet of F at interstage pressure, there is no need to have a port bridge 186 as shown in phantom line in FIG. 15. There is no need to take it out into a manifold and return it to F. The timing is fixed in that two volumes are going to one volume and the pressure ratio is absolutely fixed. Therefore, there is no need for a reed valve in the D or E stages. A high pressure discharge port 187 has a reed valve 188 closure as previously described. In this embodiment there is no need for triangular injection ports.

The trade-off for this simplification and efficiency improvement is an increase in required displacement by a factor of about 3:2 since only 2 of the three port segments draw from the evaporator. Additional improved efficiency alternatives are available with this latter configuration, however, such as:

(1) diverting liquid refrigerant to a separate (warmer) evaporator for evaporation at interstage pressure for applications such as a refrigerator/freezer where two different cold storage temperatures are desired;

(2) adding a second interstage expansion between the condenser and the low stage discharge and retaining the injection ports in port segment F;

(3) adding an interstage expansion between the low stage discharge and the lowest evaporator and retaining injection ports in port segments D and E.

Figure 16:
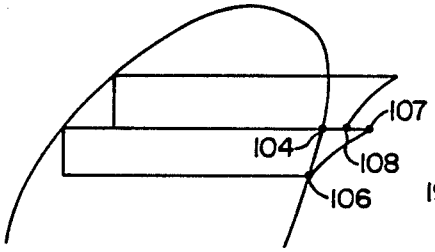
FIG. 16 is a Pressure versus Enthalpy diagram for operating conditions within a cylinder of the apparatus during operation of the embodiment shown in FIG. 15.
Figure 17:
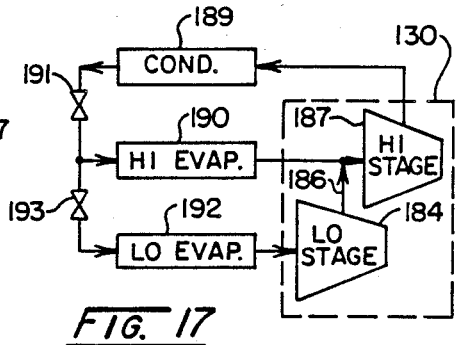
FIG. 17 is a schematic diagram of a two stage refrigeration system employing the embodiment shown in FIG. 15.

Referring to FIGS. 16 and 17, and Paragraph (1) above, the compressor of this embodiment 130 is provided with a high stage discharge from port 187 to a condenser 189 which expands liquid refrigerant to a high pressure evaporator 190 through an expansion valve 191. Discharge from the evaporator 190, at interstage pressure, meets the discharge from the low pressure stages of the compressor 130 from the outlet 184 and inlet 186. A second portion of the liquid refrigerant is conducted to the low pressure evaporator 192 through expansion valve 193.

This apparatus has a similar enthalpy diagram to that seen in FIG. 13. As shown in FIG. 16, interstage injection occurs at 104 during the final compression at point 108 when mixed with the discharge from the low pressure stage 107 which was raised from point 106 of the low stage compression. Position 107 is the ideal end point of the compression process. In this embodiment the refrigerant at 107 is at higher temperature than in the embodiment shown in FIG. 13.

Figure 18:
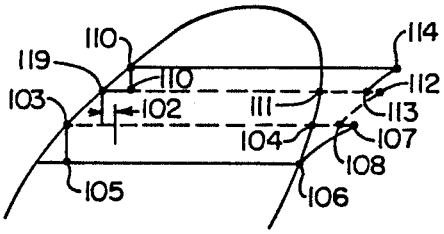
FIG. 18 is another Pressure versus Enthalpy diagram for operating conditions within a cylinder of the apparatus when the apparatus is being operated in a different refrigeration system.

FIG. 18 refers to the improved efficiency alternative of Paragraph (2) above.

Beginning at point 101, the first interstage expansion between the condenser and the lower stage discharge brings the pressure down to point 110. At this point the first interstage separation occurs, supplying vapor at point 111, and liquid refrigerant at point 119. After the second expansion and motor cooling (and any other cooling at this intermediate temperature), the cycle proceeds as before from 102 with separation to points 103 and 104, expansion to 105 and evaporation to 106. Inlet into the low pressure stage occurs at point 106 through the inlet ports of port segments D and E. In this arrangement, discharge from the low compression stage at 107 through the discharge ports in port segments D and E is mixed with the separated vapor at 104 and drawn into the high pressure compression stage at 107 as controlled by the inlet process in port segment F. When the inlet process in segment F is completed, the injection port in port segment F connects the vapor at 111 with the associated compressing chamber and injection brings the chamber conditions to point 113. Final compression occurs from 113 to 114 and discharge into the condensing heat exchanger occurs at 114 through the reed valve controlled discharge port in port segment F. In this embodiment we have three expansion stages with the final stage extended to a final upper stage and the injection port only occurs in segment F.

Figure 19:
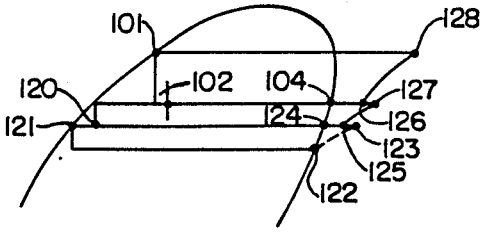
FIG. 19 is still another Pressure versus Enthalpy diagram for operating conditions within the cylinder of the apparatus when the apparatus is being operated as a compressor for still another refrigeration system.

Referring to FIG. 19 the improved efficiency alternative of Paragraph (3) above, is described. This can be accomplished through the embodiment of the invention shown in FIGS. 3–14. In this embodiment the injection ports are in segments A and B only but three expansion stages are retained. The first expansion from 101 includes motor (and any other) cooling and ends at point 102 on FIG. 19 from which separation into liquid at 103 and vapor at 104 is accomplished. The second expansion to 120 is followed by separation into vapor at 124 and liquid refrigerant at 121. The final expansion to 105 is followed by evaporation to point 106 at which point the evaporated refrigerant is drawn into the low pressure compression stage through the inlet ports of port segments A and B. The vapor at 124 is injected into the low pressure compression stage through the injection ports in port segments A and B bringing the combined refrigerant flow in the low pressure compression stage to point 125. Low pressure compression occurs from 125 to 126 and refrigerant vapor discharged through the discharge ports in port segments, A and B mixes with the separated vapor at 104 to be drawn into the high pressure compression stage at point 127 through the inlet port in port segment C. Final compression occurs from 127 to 128 with discharge to the condensor at 128 occurring through the reed valve controlled discharge port in port segment C.

Other permutations and combinations are possible based on the teaching of these disclosures.

For example, subdividing port ring 36 into five segments (instead of three) would provide similar, but not identical, function and would require that the pitch circle diameter 76 of the timing pinon 75 be reduced to 4/3 times the distance "d" and the pitch circle diameter 81 of the mating ring gear 80 be reduced to 10/3 times the distance "d".

Figure 20:
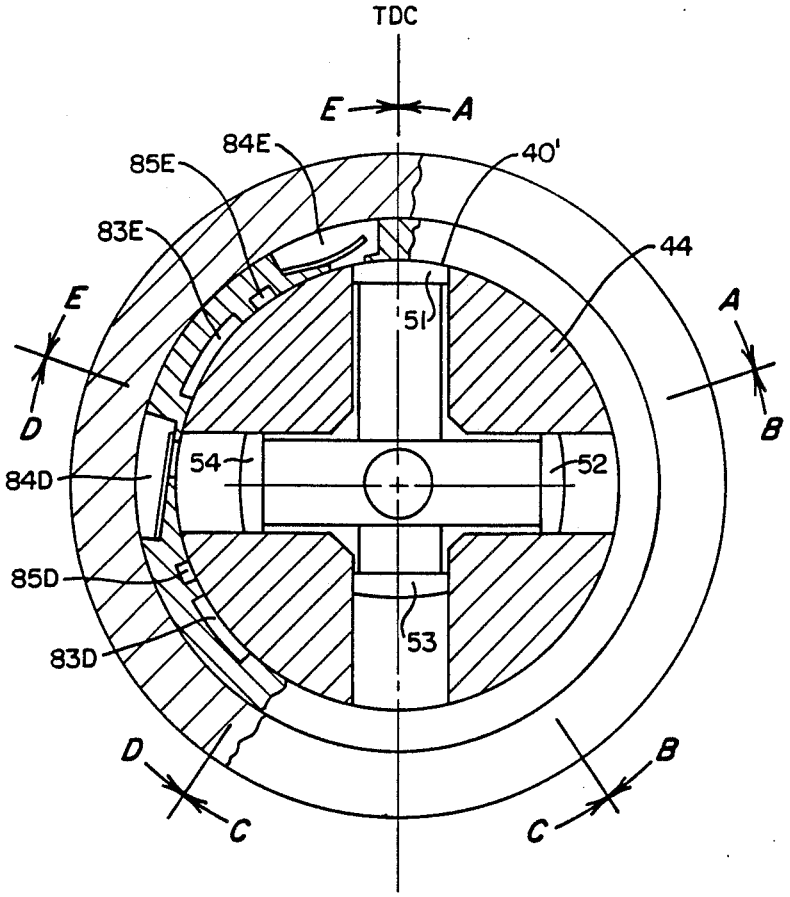
FIG. 20 is a schematic section view of another embodiment of the invention showing one more number of port sets than cylinders and pistons.

Referring to FIG. 20, a compressor apparatus having one more port set than the number of pistons and cylinders is shown, schematically. An additional two segments, D and E respectively, are shown following in circumferencial sequence after segments A, B, and C. Each segment D and E have an inlet port 83 D or E, an outlet port 85 D or E and an interstage port 84 D or E. It is apparent that the rotation of the cylinder block 44 produces a vernier progression of port closings according to the same principles as that defined in detail for the embodiment having one less port sets than the number of cylinders and pistons.

It is herein understood that although the present invention has been specifically disclosed with the preferred embodiments and examples, modifications and variations of the concepts herein disclosed may be resorted to by those skilled in the art. Such modifications and variations are considered to be within the scope of the invention and the appended claims.

We claim:

1. A compressor apparatus for pressurizing a gaseous fluid from at least one pressurized source in a plurality of different pressure stages comprising:

a plurality of pistons connected in pairs, and operating in cylinders within a rotating cylinder block, with the cylinder block rotating in an encircling port ring having a plurality of port sets, each port set including inlet, interstage, and outlet ports, with the number of port sets being one less or one more than the number of piston and cylinder combinations, the encircling port ring being stationery and a component of the supporting frame of the apparatus.

2. An apparatus according to claim 1 wherein the interstage ports are circumferencially positioned between the inlet ports and the outlet ports.

3. An apparatus according to claim 1 wherein the interstage ports are positioned to be uncovered and in communication with a cylinder at and after bottom dead center position of reciprocation of the pistons.

4. An apparatus according to claim 3 wherein the interstage ports are covered and closed before the discharge ports are opened by the rotation of the cylinders in the port ring.

5. An apparatus according to claim 1 wherein a plurality of first cylinders operate at a uniform inlet pressure and connect to equivalent inlet ports, and a lesser number of second cylinders operate at a higher outlet pressure and are connected to the outlet ports of the first cylinders.

6. An apparatus according to claim 5 wherein the interstage ports are positioned to be uncovered and in communication with a cylinder at and after bottom dead center position of reciprocation of the mating piston.

7. An apparatus according to claim 5 wherein the interstage ports are covered and closed before the discharge port sets are opened by the rotation of the cylinders in the port ring.

8. An apparatus according to claim 1, wherein the number of port sets is three and each of the three port sets are identical and are connected to a vapor compression refrigeration system in which the liquid refrigerant from a condenser is expanded through an expansion valve to an intermediate pressure separator, where it is separated into liquid and vapor portions with the vapor portion being fed to the interstage ports of each of the port sets, and with the liquid refrigerant portion being expanded through an expansion valve to an evaporator and the resulting evaporated refrigerant being fed to the inlet ports of all of the port sets, and with a condenser inlet connected to the discharge ports of all the port sets.

9. An apparatus according to claim 8, wherein the apparatus is driven by a motor and wherein the vapor from the intermediate pressure separator is passed over the motor to cool the motor, before being fed to the interstage ports.

10. An apparatus according to claim 8, wherein the apparatus is driven by a motor and wherein a portion of the liquid from the liquid/vapor separator is fed to the motor to cool the motor, and the resulting vapor is fed jointly with the vapor from the separator to the interstage ports.

11. An apparatus according to claim 1, wherein the number of port sets is three and two of the three port sets are identical, with their inlet ports connected together and to a low pressure evaporator supplied with liquid refrigerant expanded from an intermediate pressure liquid/vapor separator, with the discharge ports of the identical first two port sets connected together, to the vapor discharge of the intermediate pressure liquid/vapor refrigerant separator, and to the inlet of the third port set having the discharge port connected to a condenser.

12. An apparatus according to claim 11 wherein liquid refrigerant from the intermediate pressure vapor/-liquid separator is also fed to an intermediate pressure evaporator with the evaporated refrigerant and the separated vapor fed together to the inlet of the third port set, and the remaining separated liquid is fed to a low pressure evaporator, the evaporated refrigerant of which is fed to the combined inlets of the identical port sets.

13. An apparatus according to claim 12 wherein the liquid refrigerant that is fed to the low pressure evaporator is additionally separated into liquid and vapor at a pressure intermediate to the low and intermediate pressure evaporator pressure, with the vapor portion fed to the interstage ports of the first two port sets and with the liquid from the second separation fed through an expansion device to the low pressure evaporator.

14. An apparatus according to claim 12 wherein the liquid refrigerant from thecondenser is preliminary separated into liquid and vapor portions at a pressure between that of the condenser and the intermediate pressure evaporator, with the vapor portion fed to the interstage port in the third port set and the liquid portion fed to the intermediate pressure liquid/vapor separator.

15. A compressor apparatus for pressurizing a gaseous fluid in more than one stage, said gaseous fluid being at an inlet pressure at a first stage, an interstage pressure at a second stage, and an outlet pressure at a third stage, comprising:

a. supporting frame means having a central axis, and providing rotational support for an input crankshaft means, b. a rotatable cylinder support means having oppositely disposed radial cylinder bore means, the cylinder support means being rotatable about the central axis, in juxtaposed sliding engagement, within the frame means, c. a plurality of pistons, connected in pairs to reciprocate within opposite cylinders when moved in translation by the eccentricity of the cranking elements of the crankshaft, d. a port ring means supported by the frame means encircling the cylinder support means, having a plurality of port sets, each port set including inlet, interstage, and outlet ports constructed to intermittently communicate with the cylinder bore means during the rotation of the cylinder support means, and e. with the number of port sets being one less, or one more, than the number of pistons, providing a vernier offset in the engagement of the ports sets and cylinders during rotation of the cylinder support means and the pistons in the support frame.

16. An apparatus according to claim 15 wherein the interstage ports are circumferencially positioned between the inlet ports and the outlet ports on the periphery of the encircling port ring.

17. An apparatus according to claim 15 wherein the interstage inlet ports are positioned to be uncovered and in communication with a cylinder at and after bottom dead center position of reciprocation of the pistons.

18. An apparatus according to claim 17 wherein the interstage ports are covered and closed before the discharge ports are opened by the rotation of the cylinders in the port ring.

19. In a vapor compression refrigeration system including a vapor compressor, a condenser, an expansion valve, a separator for fluid and vapor at interstage pressure, a further expansion valve and an evaporator, the improvement wherein the compressor comprises:

a plurality of pistons connected in pairs, and operating in cylinders within a rotating cylinder block, with the cylinder block rotating in an encircling port ring having a plurality of port sets, each port set including inlet, interstage, and outlet ports, with the number of port sets being one less or one more than the number of piston and cylinder combinations, the encircling port ring being stationery and a component of the supporting frame of the apparatus.

20. The improvement according to claim 19 wherein the interstage ports are circumferencially positioned between the inlet ports and the outlet ports on the periphery of the encircling port ring.

21. An apparatus according to claim 19 wherein the interstage ports are positioned to be uncovered and in communication with a cylinder, at and after bottom dead center position of reciprocation of the pistons.

22. An apparatus according to claim 21 wherein the interstage inlet ports are covered and closed before the discharge ports are opened by the rotation of the cylinders in the port ring.

* * * * *